US011752381B2

(12) United States Patent
Verschoor et al.

(10) Patent No.: US 11,752,381 B2
(45) Date of Patent: Sep. 12, 2023

(54) SPRINKLER SYSTEM

(71) Applicant: UNICA FIRE SAFETY B.V., Hoevelaken (NL)

(72) Inventors: Tom Verschoor, Hoevelaken (NL); Henk Jan Kooijmans, Hoevelaken (NL)

(73) Assignee: UNICA FIRE SAFETY B.V., Hoevelaken (NL)

( * ) Notice: Subject to any disclaimer, the term of this patent is extended or adjusted under 35 U.S.C. 154(b) by 0 days.

(21) Appl. No.: 16/630,761

(22) PCT Filed: Jul. 18, 2018

(86) PCT No.: PCT/NL2018/050498
§ 371 (c)(1),
(2) Date: Jan. 13, 2020

(87) PCT Pub. No.: WO2019/017782
PCT Pub. Date: Jan. 24, 2019

(65) Prior Publication Data

US 2020/0179736 A1 Jun. 11, 2020

(30) Foreign Application Priority Data

Jul. 18, 2017 (NL) ..... 2019266

(51) Int. Cl.
*A62C 37/40* (2006.01)

(52) U.S. Cl.
CPC ..... *A62C 37/40* (2013.01)

(58) Field of Classification Search
CPC ..... A62C 37/40; A62C 35/68; A62C 37/04
See application file for complete search history.

(56) References Cited

U.S. PATENT DOCUMENTS 3,952,808 A 4/1976 Richardson
4,590,999 A * 5/1986 Snaper ..... A62C 37/11 169/37

(Continued)

FOREIGN PATENT DOCUMENTS

GB 2367241 A 4/2002
WO 2014115718 A1 7/2014

OTHER PUBLICATIONS

International Search Report and Written Opinion issued in PCT/NL2018/050498 dated Jan. 10, 2019.

(Continued)

*Primary Examiner* — Qingzhang Zhou
(74) *Attorney, Agent, or Firm* — Heslin Rothenberg Farley & Mesiti, PC

(57) ABSTRACT

The invention relates to a fire extinguishing system comprising an extinguishing agent supply, a distribution system at least one spray head and at least one valve mounted between the distribution system and the at least one spray head, characterized in that the at least one valve comprises an automated actuator. The invention further relates to a method of fighting a fire using this system, comprising the following steps: a) Detecting a temperature image or a smoke image by means of the sensor or a set of sensors, b) deciding if a fire is present or a normal situation occurs, c) if in the decision in b) a fire is registered, that the extinguishing agent supply is turned on, and d) on the basis of the location and the severity of that fire, one or more spray heads are actuated by means of the automated actuators connected to the valves of the spray heads.

21 Claims, 4 Drawing Sheets

(56) References Cited

U.S. PATENT DOCUMENTS

| | | | | |
|---|---|---|---|---|
| 4,984,637 | A * | 1/1991 | Finnigan | A62C 37/40 169/61 |
| 5,785,246 | A * | 7/1998 | King | B05B 1/3033 239/11 |
| 2003/0146522 | A1* | 8/2003 | Crawley | A62C 5/02 261/DIG. 26 |
| 2016/0059057 | A1 | 3/2016 | Disimile | |
| 2016/0101306 | A1* | 4/2016 | Hennegan | A62C 37/36 169/17 |
| 2017/0007864 | A1* | 1/2017 | Magnone | A62C 3/002 |

OTHER PUBLICATIONS

International Preliminary Report on Patentability dated Jun. 17, 2019.

* cited by examiner

SPRINKLER SYSTEM

CROSS REFERENCE TO RELATED APPLICATIONS

This application is a U.S. National Phase filing under 35 U.S.C. § 371 of International Application PCT/NL2018/050498, filed Jul. 18, 2018. PCT/NL2018/050498 claims priority from Netherland application number 2019266, filed Jul. 18, 2017. The entire contents of each of these applications are hereby expressly incorporated herein by reference.

The invention relates to an automatic fire sprinkler system. More specifically, the invention relates to a sprinkler system that is configured to interact adaptively with fire incidents.

Sprinkler systems are configured to start spraying water over a fire in order to cool down the burning material to such an extent that the fire is stopped from progressing and extinguished. In the art, these kind of sprinkler systems are generally equipped with a water supply, being a pump and/or a water storage container, a distribution net comprising headers and conduits for the supply of water, upstream being connected to the water supply and downstream to a series of distributed spray heads, or spray nozzles. These spray heads are connected to the conduits of the distribution net for providing a spray pattern of water in the premises to be protected, when a fire is detected.

In the art, the most common type of spray head is provided with a fuse, often a glass bulb filled with liquid with a very specific boiling point. When a fire or the heat of a fire approaches the fuse, the liquid starts to boil. This boiling will generate pressure inside the bulb higher, resulting the bulb to burst. The bulb is generally directly or indirectly keeping a stopper or stem against the exit opening of the spray head. When the fuse bursts, the stopper or stem is no longer kept at its place. Thus, the stopper or stem is removed by the water pressure and water starts to exit the spray head. The fuse sometimes is equipped with a low melting metal alloy instead of a glass bulb, where the metal that keeps the stem or stopper in place is configured to melt at a dedicated temperature. These systems have proven effective in fighting fires all around the world for at least a century. These systems are however connected to a series of disadvantages.

When a fire has triggered a fuse of a spray head, that spray head is turned on till the system as a whole or at least a relevant section thereof is switched off. Thus, a spray head remains spraying even if the initial fire has been extinguished. This may result in considerable damage to building, its inventory and its comprising assets caused by excess of water. Furthermore, these systems are typically designed for a maximum flow corresponding to four to twenty spray heads, activated by fire. If more spray heads are activated, the system is in general inapt to supply sufficient water to provide for the needed spray cones. Thus, if a fire is progressing through a building, it may, after having triggered a series of spray heads, not be sufficiently contained because of inadequate capacity of the system. Therefore, these traditional systems have been altered in various ways. Some examples of systems described in the art are listed below.

The American Patent Application US-A-2016/0059057 for instance discloses a sprinkler system wherein a sprinkler head is provided with a series of ports, with individually varying orientations, being installed relatively close to each other. When the various ports are steered open or closed, the jets exiting the port may interact, such that the flow of the extinguishing agent can be directed. Although an elegant solution, this arrangement is less suitable for a wide variety of volume, spray pattern and droplet sizes.

The U.S. Pat. No. 3,952,808 B discloses a combined air sampling and fire extinguishing system. In this document, the control of the spray pattern and droplet size of the fire extinguishing agent is not disclosed.

The International Patent Application WO-A-2014/115718 discloses a fire extinguishing where the sprinkler heads are controlled by a valve. This document discloses an open-close system, wherein neither the droplet size nor the spray pattern of the sprinkler heads can be controlled.

One adaptation was installing valves directly upstream of each spray head, with a temperature sensor close to the spray head. This sensor, unlike a fuse, remains in service, and once e.g. a first set temperature limit is surpassed, it triggers the valve to open, such that the water can exit the relevant spray head. In the occasion the fire is sufficiently reduced or extinguished, a second set temperature is undercut, resulting in that the valve can be reclosed, such that the water flow is stopped. Thus, excess of water can be prevented. This is advantageous both for the damage reduction due to the water and the capacity problem of too many open valves is reduced as well. An example can be seen in the American Patent Application US-A-2017/0007864. This document discloses a sprinkler system, in which individual sprinkler heads are controlled by either a one time opening by breaking a fuse or controlled by a solenoid valve. A drawback of this system is that the spray pattern and droplet size of the extinguishing agent cannot be controlled on a level of the individual spray heads.

Still these systems know some drawbacks. For instance, with a slowly progressing fire or smouldering fire, where the heat at the location of the spray heads, i.e. typically mounted in or at the ceiling is not reached. Thus, a fire can progress while no spray head is activated. since a vast amount of fire casualties are triggered by smoke inhalation, this is still not an optimal safety system.

Accordingly, it is an object of the invention to mitigate or solve the above described and/or other problems of fire-fighting systems in the art, while maintaining and/or improving the advantages thereof. More specifically the object of the invention can be seen in providing a system and a method that is more responsive to the kind of fire it may find itself confronted with, which minimises the amount of fire extinguishing agent while accurately and swiftly responding to any fire risk.

These and/or other objects are reached by a fire extinguishing system comprising an extinguishing agent supply, a distribution system at least one spray head and at least one valve mounted between the distribution system and the at least one spray head, characterised in that the at least one valve comprises an automated actuator.

Thus, the individual spray head can be switched on and off, being able to reduce the amount of extinguishing agent used to fight the fire. The actuator of the valve can be electromagnetically operated and remotely be actuated.

The actuator of the at least one valve can be controlled by means of a sensor or a set of sensors, being configured to measure a temperature, a temperature differential, a smoke density, or a smoke density differential. Herein, a processing device can collect the data of the set of sensors, and can generate a fire image and can control the at least one valve of the at least one spray head, on the basis of this fire image. The system can comprise a series of spray heads with each having its own control valve installed between the spray head and the distribution system.

Thus, spray heads in dedicated areas can be set to spray, and being monitored while the fire image is continuously being monitored and updated by the sensors. As soon as a fire is spreading, more spray heads are triggered and engaged in extinguishing, whereas if the fire image is reduced, spray heads can be switched off again one by one.

In this way, a very dedicated, precision fire safety system can be provided that is extinguishing on the spot, when required, and not more than necessary to extinguish.

In many cases the distribution system between the spray heads and the agent supply is kept dry or even under negative pressure. Advantages thereof are, that the system is less susceptible to corrosion. Furthermore, unintentional leakages in such a dry system will not lead to any damages caused by any exiting of extinguishing agent. Another advantage of such dry system is that no heating or tracing needs to be applied, when the system is confronted with potential frost conditions.

When such a system is applied, it needs to be cleared from extinguishing agent, after the system has been activated. The clearing of the system can be performed in a more practical way, in that the system is set to a negative pressure at preferably a central location, e.g. close to the supply of the extinguishing agent. Once the pressure is negative, the valves can be opened one by one, such that each part of the system is consecutively cleared from remaining extinguishing agent.

The sensors of the system can be part of a distributed network, which can present information about the location of a registered fire to internal or external emergency services. Thus, emergency services, such as fire men or medical aid service specialists can enter a building, go directly to the right floor, to the right location of that floor while losing minimal time in searching for the location of the zone where the fire was registered.

The response time of the individual spray heads can be set, for instance in situations, where people are immobile or unable to move, e.g. in a hospital or retirement home, to maximum sensitivity. Here the spray heads may be triggered sooner and/or longer, leading to more extinguishing agent being used. In this case, the potentially increased damage of extinguishing agent can be accepted in order to save the maximum amount of lives.

In the system, the opening of the control valve is controlled by the sensors, the distributed network and/or the processing device, thus controlling the individual output of each individual spray head. Here the actuator of the valve acts as a "proportioner" and can vary the opening of the valve. In the sprinkler industry, the performance of a spray head is typically measured by a resistance factor or K-factor. By changing this factor of the individual valve, the amount of water, the pressure difference over the spray head, the shape of the spray pattern can be controlled.

Furthermore, in this system, the size of the droplet size of an extinguishing agent can be controlled by the size of the opening of the valve. For instance, if the pressure difference is around 5 bar at the spray head and water is used as extinguishing agent, a water mist of fine droplets is generated, which has specific extinguishing properties different from a water spray exiting a spray head at a pressure difference of e.g. 0.5 bar.

A fine droplet mist is for instance capable of absorbing high thermic loads such as hot gases generated by the fire to be extinguished. Next thereto, these mists can absorb heat radiation and can render a potential source of fire inert to fall prey to the flames.

In case of a strong fire and/or a rapidly extending fire, high water loads are preferred. Thus, the valves of the relevant spray heads can be opened fully, such that e.g. K-factors up to 100 may be reached resulting at appropriate supply to a 150 l/min of water spray where a pressure difference over the spray head may be 2 bar or even less. In this case, relative big droplets are generated that may pre-wet any flammable material, e.g. carpets, inventory, and walls, not yet reached by the expanding fire to be extinguished.

The judgment of the severity of the fire, and the consequent decision on which valves to open, and to which extend is performed by the processing device, is performed by a central or distributed information processing unit, based on the generated dynamic images of the fire it generates on the basis of the parameters collected by the network of sensors.

Thus, a traditional sprinkler system can be given the advantages of a water mist system resulting in that fires can be fought in a more intelligent manner, while reducing the damage the water is generating.

The system can be applied at controlling and extinguishing fires in e.g. storage systems, warehouses, and industrial complexes. Furthermore, it can be applied as life safety sprinkler in locations where immobile people are residing such as hospitals, child care locations or retirement homes.

In these systems, the distribution network can act as an air sampling aspiration system, collecting air from individual spray heads. This may be applied, when a rapid detection of a fire, i.e. when temperature and smoke image are still insufficient to register a fire, yet smouldering material may provide detectible amounts of typical fire generated gases. A centrally installed smoke detection system may be applied, which is confronted with air samples collected by the system, by opening each individual valve of each individual spray head consecutively. If a negative pressure is maintained in the system by means of e.g. a pump or compressor, the valve that is opened may inhale some air from its installed location.

The air sampling can be occurring consecutively, spray head after spray head, by opening consecutively each connected valve. By applying a sequence of opening each valve, a pattern of each location can be generated, and if smoke is detected, with the pattern it can be deduced from which location said smoke is originating. Since the system is already equipped with a distribution network and valves and spray heads in each location, it may be used as an air sampling system relative easily.

Since each spray head can act as an air intake which can be opened and closed, a neat and exact location of a potential fire can be detected at a very early stage. The invention thus relates to a method of fighting fires, comprising the following steps: a) Detecting a temperature image or a smoke image by means of the sensor or a set of sensors, b) deciding if a fire is present or a normal situation occurs, c) if in the decision in b) a fire is registered, that the extinguishing agent supply is turned on, and d) on the basis of the location and the severity of that fire, one or more spray heads are actuated by means of the automated actuators connected to the valves of the spray heads. Herein, the method can comprise a further step: e) the opening of each individual valve is controlled by the registered temperature or smoke image. Furthermore, herein, before step a) a sampling sequence is performed by opening consecutively each individual valve of each individual spray head, in order to collect air samples from the locations of the spray heads.

In order to further elucidate the invention, exemplary embodiments will be described with reference to the figures. In the figures.

The figures represent specific exemplary embodiments of the inventions and should not be considered limiting the invention in any way or form. Throughout the description and the figures the same or corresponding reference numerals are used for the same or corresponding elements.

The expression "control valve" used herein is to be understood as, though not to be considered limited to a valve of which the opening can be controlled between a closed position and a maximally open position by means of an actuator. This actuator can be operated e.g. hydraulically, electrically, pneumatically or otherwise.

The expression "negative pressure" used herein is to be understood as a pressure below atmospheric, so it can mean a mild or even high negative pressure.

Figure 1:
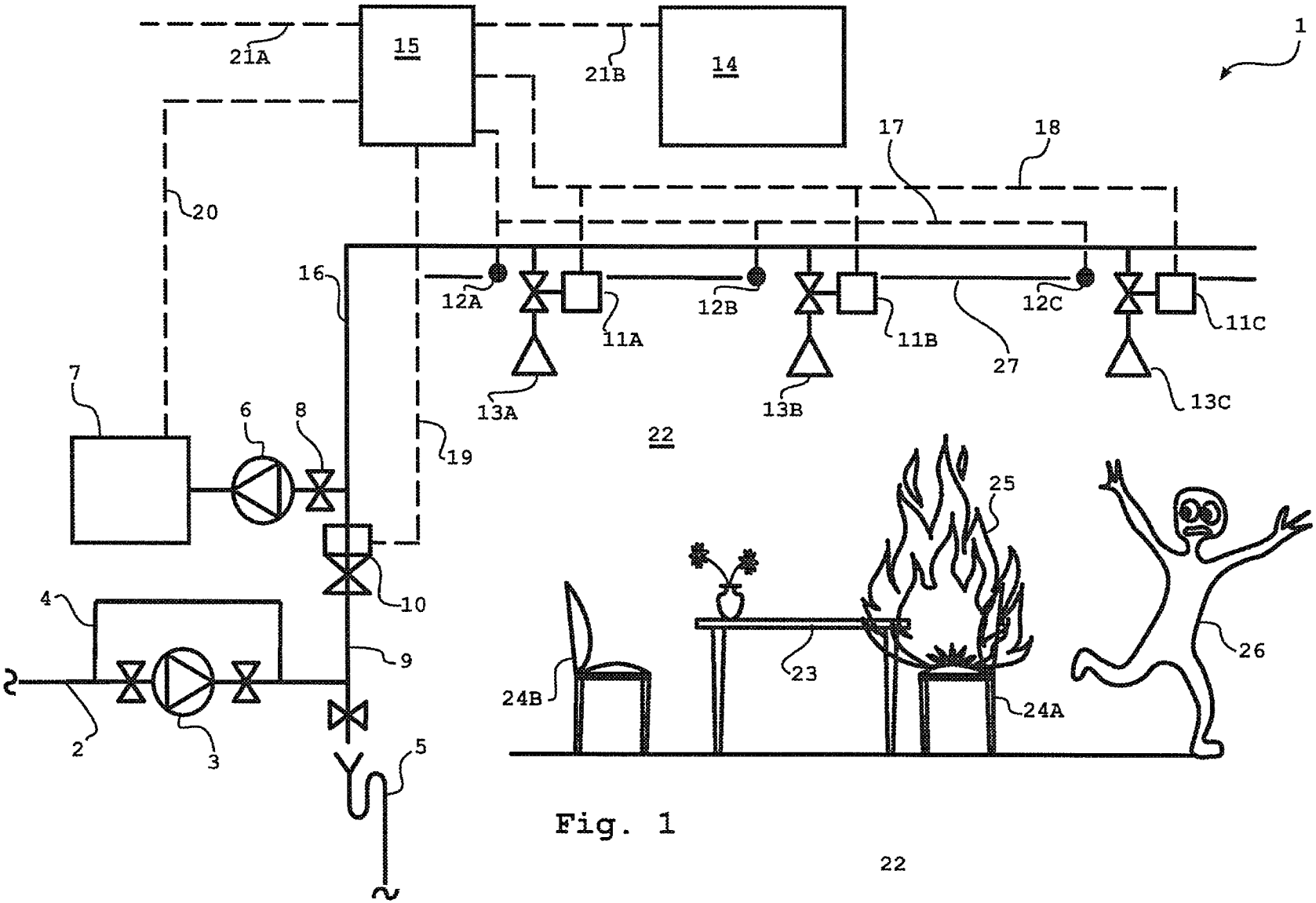
FIG. 1 depicts a first schematic view of a sprinkler system to an embodiment of the invention.

In FIG. 1, a schematic view of the sprinkler system 1 is depicted. in this description below, firstly the various elements of the depicted system 1 are described, thereafter the functioning of the system 1 will be elucidated. The system 1 comprises a water supply 2, a fire pump 3 with a bypass 4, being connected to a distribution system 9. The water supply 2 can for instance be a water storage tank or a town main water distribution systems connection. The distribution system 9 is connected to an alarm section valve 10 which is downstream connected with a further distribution system 16. The distribution system 9 is generally a pipe system manifold, being in normal operation filled with water or other extinguishing agent.

Although, in the schematic diagram as depicted in FIG. 1, only one alarm section valve 10 is depicted, in most buildings more sections are connected to the system 9, each with its own alarm section valve 10. Generally, each floor of a building is equipped with a sections, and in large buildings, the floors as such are further divided into sections. So the distribution system 9 can in that case be an extensive manifold. The alarm section valves 10 are configured to be activated by the control panel 14. In the distribution system 9 and/or 16 drains can be integrated, such as system drain 5, which can be used after system operation, in order to drain the system 9 and/or 16. The distribution system 16 generally branches of in the rooms 22 of a building, where it is most of the time hidden above or integrated in a ceiling 27. Connected to this distribution system 16 are spray heads 13, in this exemplary system, there are three spray heads 13A, 13B and 13C connected to the distribution system 16. The spray heads can be configured as open extinguishing nozzles or integrated nozzles as depicted in more detail in FIG. 2.

In dry fire extinguishing systems, in normal conditions, when the system 1 is idle, the distribution system 16 is kept at a reduced or negative pressure, and is substantially kept dry. Each spray head 13A, 13B and 13C is respectively connected to a control valve 11A, 11B and 11C. In most cases, both the spray heads 13 and the sensors 12 are integrated in the ceiling 27 of a room 22. The control valves 11 can be of an on-off type or can be configured as proportioner valve with a solenoid, being configured to create orifices from closed, partly opened up to totally open e.g. over a range of 0% to 100%.

To the distribution system 16 can be further connected a compressor 6, being on its upstream side, between the compressor 6 and the distribution system 16 provided with a valve 8. Downstream of the compressor 7 can optionally be installed a sampling system 7. The compressor 6 is installed as a reversed compressor, configured to create a reduced or negative pressure within the distribution system 16 to monitor the system. In case of major leakage the compressor 6 is no longer able to maintain the reduced or negative pressure in the system and will generate a default message to the control panel 14.

The system 1 further displays a sensing and control system, comprising sensors 12A, 12B and 12C, being connected by means of he sensing signaling line 17, acting as an input to a control unit 14. The sensors can for instance be temperature sensing devices equipped with a sensing range of −40° up to +200° Celsius.

In this sensing and control system, the potential sampling unit 7 can also be connected to the control unit 14 by means of data transmitting line 20, acting as an input for the control unit 14 as well.

The control unit 14 can generate controlling output signals going to e.g. an optional interface 15 by means of the control signal transmitting line 21B, to the control valves 11 by means of control signal transmitting line 18, to the alarm section valve 10 by means of control signal transmitting line 19, and to further external and/or internal rescue services such as a fire brigade, by means of control signal transmitting line 21A. The interface 14 is a geographic panel of the building configured to inform rescue services where and when the fire occurs within the building.

The firefighting system 1 is configured to contain and extinguish a fire 25 in a room 22. In the example described herein, water is used as an extinguishing agent. In most sprinkler systems, this is actually the case. In case of fire 25 is starting in a room 22, the fire will be detected by the sensors 12. The sensors can be equipped e.g. with a temperature sensing range of −40° up to +200° Celsius. Here various other types of heat sensing or detecting devices may be applied, such as infra-red camera's. In the diagram shown in FIG. 1, the spacing of these sensors 12A-C are the same as the spacing of the extinguishing nozzles 13A-C.

This means, that in the protected area, i.e. room 22, more sensors 12A-C can provide signals to the control unit 15. Thus control unit 15 is able to retrieve data from the fire and will collect information about the rate of temperature rise per time unit and the fire load (energy). By this information, the control unit can generate a specific image of a fire.

Once the collected data indicates there is a fire, the control unit 15 will initiate that pump 3 will be started, the alarm section valve 10 will be opened, valve 8 will be closed and water will flow through the distribution system 16 to the valves 11A-C.

In FIG. 1, the sensors 12B and 12C are likely to providing a more rapid temperature response to the control unit 14, than sensor 12A, which is at a further distance from the fire 25. Thus the control unit 15 can steer the valves 11B and 11C to be opened sufficiently more than valve 13A, where the water is predominantly distributed to wet any potential flammable material such as the table 23 and the chair 24B. The size of the opening of the orifice of the valves 11A-C is commanded by the proportioner valve solenoid, able to create orifices from closed, partly opened up to totally open as it is explained in more detail in FIG. 2.

Figure 2:
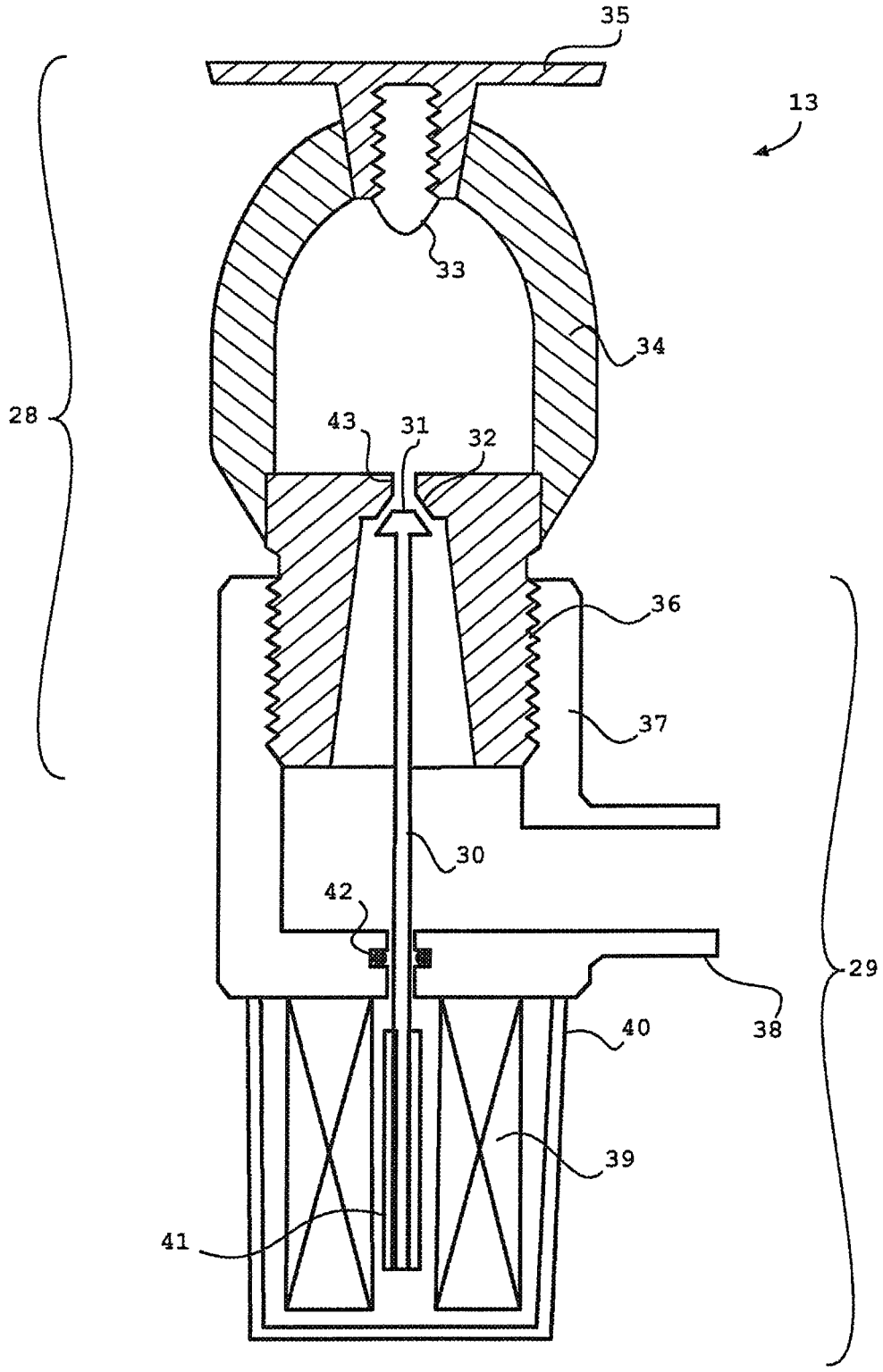
FIG. 2 depicts a schematic cross sectional view of a sprinkler head according to a further embodiment of the invention.

In FIG. 2 a cross sectional view of an example of a spray head 13 is depicted. The spray head in this example can comprise an ordinary off shelf sprinkler head 28, which is connected to a valve add-on 29, by means of its thread connection 36. The sprinkler head 28 is equipped with a nozzle 43, of which the inner opening acts as a seat 32 of the closing member 31 of the valve add-on. The sprinkler head 28 comprises a deflector centre 33, and a deflector plate 35, which are held in place by the bracket 34.

the control valve add-on comprises a housing 37, configured to be connected to the sprinkler head 28 by means of the thread connection 36. The housing 37 is further equipped with an inlet connection 38, configured to be connected to a distribution system 16, as is depicted in FIG. 1. Connected to the housing 37 is a further housing 40, covering and closing off the solenoid coils 39 of the valve. In the solenoid coils the stem 30 of the valve 13 is able to move in a substantially axial direction. Connected to the stem is a magnet 41, which is able to be positioned in a precise way by means of the solenoid coil 39.

If the closing member 31 is sitting against the seat 32, the valve will be closed and no water is able to escape the nozzle 43. If the closing member is moved an over a small distance from the seat 32, a tiny slit is built in between the closing member 31 and the seat 32. Thus when water under pressure is within the housing 37, most pressure drop will occur in this slit, generating very high shear forces at the nozzle opening, such that the exiting jet is immediately broken up in very tiny droplets, exiting the nozzle 43 as a cone.

If the closing member 31 is moved further away from the seat 32, more water will be able to flow in a less restricted way, such that the pressure drop over the slit will be lower, resulting in lower exit velocities of the water, exiting nozzle 43. Thus, less severe shear forces lead to the exiting water jet breaking up in bigger droplets.

Upon further opening of the slit between the closing member 31 and the seat 32, a water jet will exit that is only breaking up at the impingement point with the deflector centre and the deflector plate 35. Here large drops will be generated.

Figure 3:
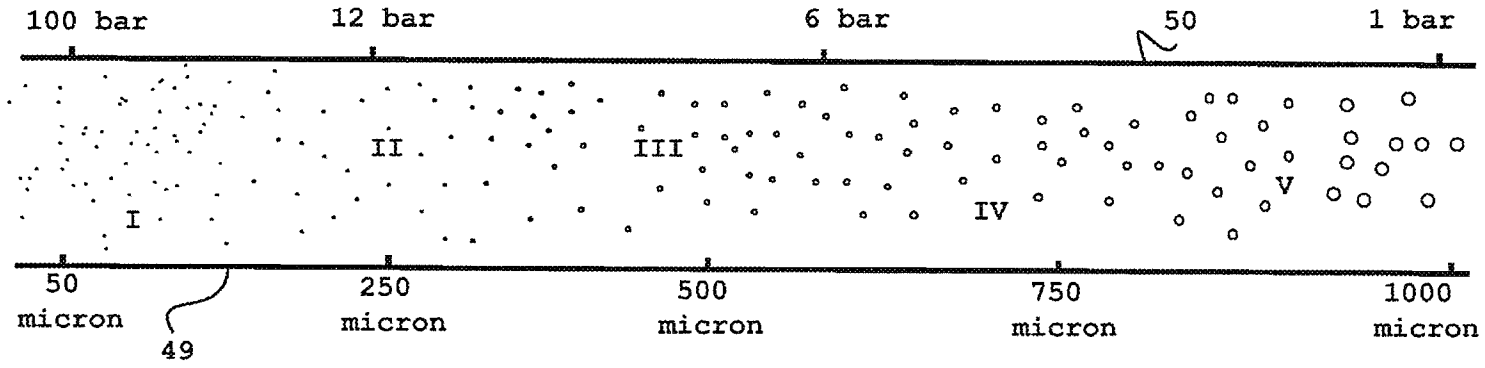
FIG. 3 depicts a schematic diagram of the various sprinkler types in the art and their characteristics.
Figure 3:
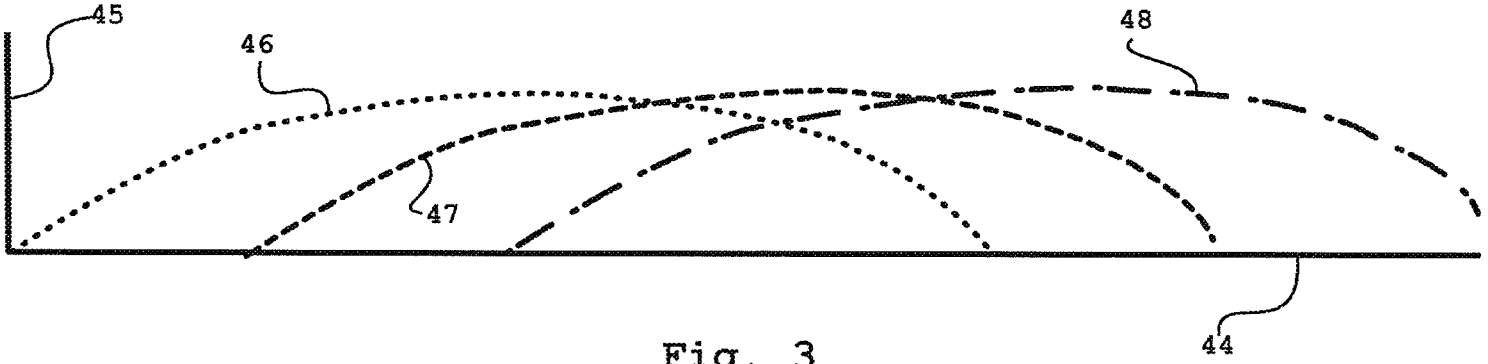

In the schematic diagram of FIG. 3, droplet sizes of three types of available sprinkler head types are depicted. In the lower part, an horizontal axis 44 is depicting from left to right the increasing droplet size, and on the vertical axis 45 is depicted the mass fraction of droplets within the corresponding droplet size of three types of commercially available sprinkler nozzles. the Area 46 represents a high pressure water mist sprinkler nozzle, the Area 47 represents a low pressure water mist sprinkler nozzle and the are 48 represents a normal sprinkler head. In the upper part of the diagram a graphical representation of the various droplet sizes is given between two further axis. The first of these axis 49 represents the droplet sizes in micrometre, the second axis 50 represents the pressure drop over the nozzle in bars absolute. From this image it becomes clear that any sprinkler system is limited to the droplet size by the choice of the type of system installed with the corresponding sprinkler heads.

Figure 4:
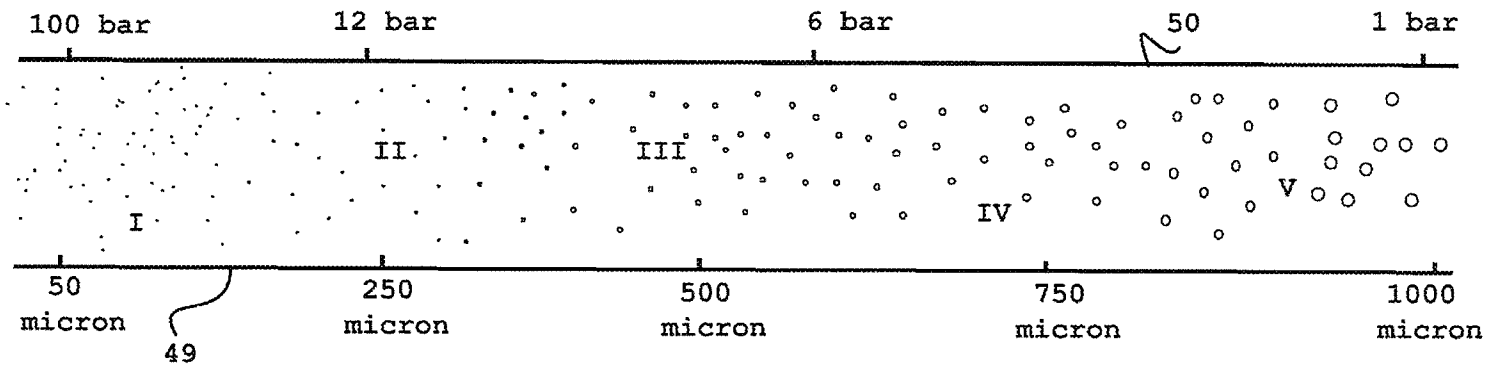
FIG. 4 depicts a schematic diagram of the sprinkler head with valve according to an embodiment of the invention.
Figure 4:
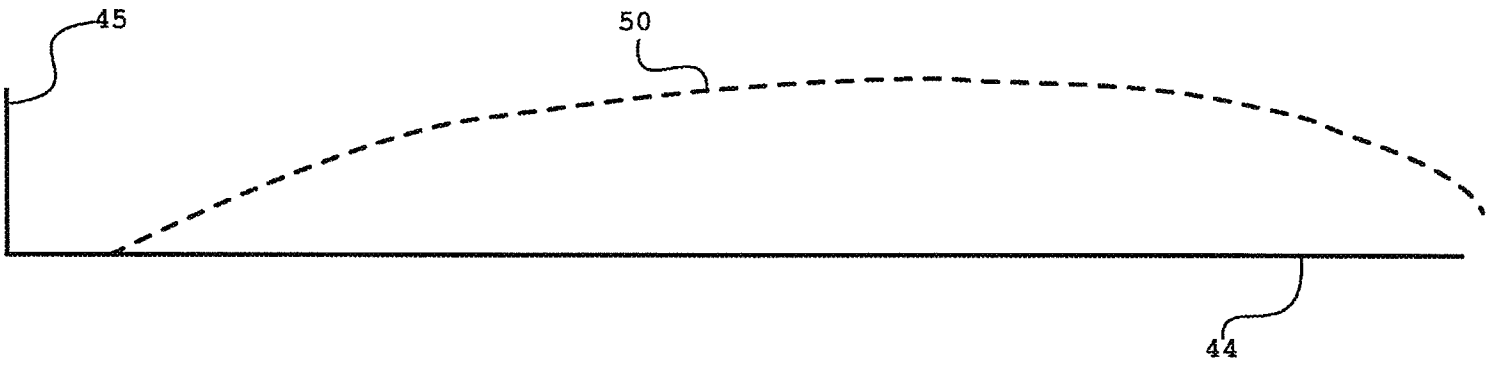

In FIG. 4, the operating area 50 of a sprinkler head with varying orifice according to the invention is depicted. Here it becomes clear that by the varying orifice size, a wider range of droplet sizes can be generated. Droplets from the 200 micrometre up to 1000 micrometre can be generated.

In the following examples the functioning of the valve will be further elucidated.

In case of a low energy fire for example with a heat release rate=1 MW in 300-600 seconds, the orifice can be opened appr. up to K factor 20 (metric), with a nozzle pressure of 5 bar, this means that about 45 litre per minute will flow with an average droplet size of 0.2 up to 0.5 mm, which is similar to low pressure water mist. This water-spray can block thermal radiation, absorb heat from the hot fire gases and prevent flash-overs and extinguish the fire.

In case of a medium energy fire, for example with a heat release rate equaling 1 MW in 150-300 seconds, the orifice will can be opened up to K factor 80 (metric), with a nozzle pressure of 2.5 bar this means that 130 litre per minute will flow with an average droplet size of 0.5 up to 0.7 mm. This water-spray will pre-wet the ceiling, floor, walls and interior of the burning room and prevent further fire development and extinguish the fire. This water spray will also generate water mist droplets to block thermal radiation and absorb heat from the hot fire gases and prevent flash-overs and extinguish the fire.

In case of a high energy fire for example with a heat release rate equaling 1 MW in 75 seconds, the orifice(s) will be opened up to K factor 115 (metric), with a nozzle pressure of 1.5 bar this means that 140 litre per minute will flow with an average droplet size of 0.7 up to 1 mm. This water-spray will pre-wet the ceiling, floor, walls and interior of the burning room and prevent further fire development and extinguish the fire. Because of the high fire load more than 1 nozzle will be opened in order to generate the so called deluge effect. In FIG. 1, this means that both nozzles 13B and 13C are fully open.

In the example given in FIG. 1, alternatively, spray head 13C can be opened at 100%, i.e. a K factor of 115, resulting in big droplets in the heart of the fire and surrounding nozzles, i.e. the spray heads 13A and 13B can be opened at 30%, with a K factor of 20 resulting in small droplets: Thus, the fire will be drowned in the centre and encapsulated by water mist in its periphery.

By monitoring the interaction between the fire and development of the extinguishing process the system will optimize the right amount of nozzles, the right flow in combination with the right droplet sizes. And in the end it will decide at the right moment that the fire is extinguished and the system will be stopped. Simultaneously with the activation of the system the control cabinet will sent information to the geographic panel to inform the fire brigade or rescue staff about when and where in the building the fire has occurred.

In case there is only one temperature device e.g. a small room, there will be an on-off sequence: after 5 minutes of extinguishing there will be an interval of 1 minute to stop the system and to reset the temperature measuring and analyse if there is still a high temperature. If yes the extinguishing will restart, if no the system will stopped.

As an option, an air sampling unit 7 can be installed within the system 1. Where fire risks with smouldering fires can be expected, for example when hospital beds take fire, this optional sampling unit 7 may enhance the safety of the system. The unit 7 can analyse air samples on the presence of smoke particles in the protected area, by sucking air through the control valves 11 and the spray heads 13. The optional device can be set to analyse air samples on the presence of smoke particles in the protected area, by sucking air through the proportioner of the individual valves 11A-C and spray heads 13A-C, through the distribution system and the compressor 6. the air can be analysed in air sampling unit 7. If the individual valves are opened, air originating from a specific location can be sampled and analysed. if a valve opening sequence is performed with a predetermined scheme, the origin of the air arriving at the sampling unit 7 can be deduced. by inspecting the air on smoke particles, an early fire detection can be obtained. Once the system 1 is activated, and water is inside the distribution system 16, the air sampling is no longer possible, up to the system is again fully drained. In such a case the valve 8 will be automatically closed, also to prevent water from entering the compressor 6.

After the system has been activated and the fire is extinguished, the extinguishing agent can be drained by the system drain 5. However, the vertical drop pipes i.e. the pieces of pipe directly upstream of the valves 13 are impossible to drain and thus residual water will remain therein. These drop pipes and other system parts with locked water can easily be drained by slightly opening the control valves 13 e.g. at 10%. Due the negative pressure in the system the remaining water will be sucked out and will be transported to the drain 5. By keeping the system 100% dry in stand-by situation, no anti-freezing measurements have to been taken and corrosion of the system interior piping can substantially be eliminated.

By making automatic sprinkler systems intelligent and inter-active as proposed by current invention, it is the objective to extinguish fires with the lowest amount of used spray heads as possible. In residential buildings, apartments and family homes, this can mean a maximum of e.g. 2 sprinklers. In utility buildings like offices, hotels, schools and hospitals it can imply the usage of a maximum of e.g. 4 sprinklers. In industry buildings like industrial production plants, warehouses and waste processing this may imply using a maximum of e.g. 6 sprinklers.

In these applications, the reduction in number of spray heads used can lead to smaller water supply lines, smaller pipes, less water consumption and less water damage.

The invention is to be understood not to be limited to the exemplary embodiments shown in the figures and described in the specification. For instance, the fire extinguishing agent is described to be water, which is in most cases the agent of choice. However other fluids may be used, such as foams, gases, mixes of various compounds to steer extinguishing properties, emulsifying properties, surface tension properties, viscosity properties of the extinguishing agent. Typical the pressure range of the systems envisioned by the invention is in the order of 0.5 to 200 bar, however other pressures may be applied. In het examples the valve is of a stem and seat type, yet other valve types may be applied in a similar fashion. E.g. a diaphragm valve may be placed in the vicinity of the nozzle 43 of the sprinkler head 28 instead. The various valves may be operated through wired connections to a central processing system, but may also be activated wirelessly, e.g. by electromagnetic waves e.g. radio controlled. These and other modifications are considered to be variations that are part of the framework, the spirit and the scope of the invention outlined in the claims.

LIST OF REFERENCE SIGNS

1. Firefighting system
2. Water supply
3. Fire pump
4. Bypass
5. Drain
6. Compressor
7. Air sampling unit
8. Valve
9. Distribution system
10. Alarm section valve
11A-C. Control valve/proportioner
12A-C. Sensors
13A-C. Spray heads
14. Geographic panel
15. Control unit
16. Distribution system
17. Sensing signal transmitting line
18. Control signal transmitting line
19. Control signal transmitting line
20. Data transmitting line
21. Signal to rescue services
22. Room
23. Table
24. Chair
25. Starting fire
26. Escaping person
27. Ceiling
28. Sprinkler head
29. control valve add on
30. Stem
31. Close off member
32. Valve seat
33. Deflector centre
34. Bracket
35. Deflector plate
36. Thread connection
37. Housing
38. Inlet connection
39. Coil
40. Housing
41. Magnet
42. Seal
43. Nozzle opening
44. Axis
45. Axis
46. Area
47. Area
48. Area
49. Axis
50. Axis
I-V Areas

The invention claimed is:

1. A fire extinguishing system comprising an extinguishing agent supply, a distribution system, at least one spray head or a series of spray heads, and at least one valve mounted between the distribution system and the at least one spray head or the series of spray heads, wherein the at least one valve comprises an automated actuator, wherein the valve is a control valve having an orifice with a variably controllable opening, the valve being in direct contact with the spray head such that the orifice is configured to direct a flow of an extinguishing agent directly at a center portion of the spray head, the valve being configured to variably configure the opening from closed, to partly opened and up to totally open over a range of 0% open to 100% open, the valve thus being configured to change a K-factor of the valve, controlling the amount of water, a pressure difference over the spray head, a spray pattern shape and/or droplet size of the extinguishing agent and a reverse compressor in fluid communication with the distribution system and operable to maintain a reverse pressure on the distribution system when the distribution system is not filled with the extinguishing agent;

wherein each of the valves of the at least one valve acts as an air sampling aspiration system, the valves operable to sample air from each of the spray heads of the at least one spray head or series of spray heads when a negative pressure is applied to the distribution system by the reverse compressor.

2. A fire extinguishing system according to claim 1, wherein the automated actuator of the at least one valve is controlled by means of a sensor or a set of sensors, being configured to measure a temperature, a temperature differential, a smoke density, or a smoke density differential.

3. A fire extinguishing system according to claim 2, wherein a control unit is configured to collect data of the sensor or the set of sensors, and is configured to generate a fire image and is configured to control the at least one valve of the at least one spray head, on the basis of the fire image.

4. A fire extinguishing system according to claim 2 wherein the system comprises the series of spray heads with each having its own control valve installed between the spray head and the distribution system.

5. A fire extinguishing system according to claim 2, wherein the sensor or the set of sensors are part of a distributed network, which is configured to present a location of a registered fire to internal or external emergency services.

6. A fire extinguishing system according to claim 5, wherein the variably controllable opening of the control valve is controlled by the sensors or the set of sensors, the distributed network and/or a control unit, thus controlling an individual output of each spray head.

7. A fire extinguishing system according to claim 6, wherein droplet size of the extinguishing agent can be controlled by the size of the variably controllable opening of the valve.

8. A fire extinguishing system according to claim 1, wherein air sampling occurs consecutively, spray head after spray head of the at least one spray head or series of spray heads, by opening consecutively each connected valve of the at least one valve.

9. A method of fighting a fire using the system of claim 1, comprising the following steps:

a) detecting a temperature image or a smoke image by means of a sensor or a set of sensors, b) deciding if a fire is present or a normal situation occurs, c) if in the decision in b) a fire is registered, the extinguishing agent supply is turned on, and d) on the basis of the location and the severity of the fire, one or more spray heads are actuated by means of the automated actuators connected to the valves of the spray heads, wherein the valves are control valves having an orifice with a variably controllable opening, the valves being in direct contact with the spray heads such that the orifice is configured to direct a flow of the extinguishing agent directly at a center portion of the spray head, the valves being configured to variably configure the opening from closed, to partly opened and up to totally open over a range of 0% open to 100% open, thus being configured to change the K-factor of the valve, controlling the amount of water, the pressure difference over the spray head, the shape of the spray pattern and/or the size of the droplets of the extinguishing agent.

10. A method according to claim 9, wherein the method comprises a further step:

e) the opening of each valve is controlled by the temperature image or the smoke image.

11. A method according to claim 9, wherein before step a) a sampling sequence is performed by opening consecutively each valve of each of an individual spray head, in order to collect air samples from the locations of each of the individual spray heads.

12. A fire extinguishing system according to claim 2 wherein the system comprises the series of spray heads with each having its own control valve installed between the spray head and the distribution system.

13. A fire extinguishing system according to claim 3 wherein the system comprises the series of spray heads with each having its own control valve installed between the spray head and the distribution system.

14. A fire extinguishing system according to claim 3 wherein the sensor or the set of sensors are part of a distributed network, which is configured to present a location of a registered fire to internal or external emergency services.

15. A fire extinguishing system according to claim 4 wherein the sensor or the set of sensors are part of a distributed network, which is configured to present a location of a registered fire to internal or external emergency services.

16. A fire extinguishing system according to claim 2 wherein the distribution system acts as an air sampling aspiration system, collecting air from individual spray heads.

17. A fire extinguishing system according to claim 7 wherein the distribution system acts as an air sampling aspiration system, collecting air from individual spray heads.

18. A method according to claim 10 wherein before step a) a sampling sequence is performed by opening consecutively each valve of each individual spray head, in order to collect air samples from locations of the spray heads.

19. The fire extinguishing system of claim 1, wherein the control valve further comprises:

a nozzle, wherein the nozzle includes the orifice disposed on one side of the nozzle and a conical seat disposed on an opposing side of the nozzle;

a closing member having a conical shape to conform to the conical seat, wherein the variable controllable opening of the orifice comprises a symmetrical space between the closing member and conical seat;

a stem having a distal end that is integrally connected to the closing member; and a solenoid coil through which the stem extends, the solenoid coil being operable to position the closing member axially to vary the opening from closed to partly opened to totally open.

20. The fire extinguishing system of claim 19, wherein:

when the opening is closed, water acting as the extinguishing agent will not flow through the control valve;

when the opening is partly opened, water exits the control valve in a conical spray pattern having water droplets of a first size; and when the opening is fully opened, water exits the control valve in a second pattern that is different from the conical spray pattern and having water droplets of a second size that is larger than the first size.

21. The fire extinguishing system of claim 20, wherein the water droplets of the first size and water droplets of the second size vary within a range of 200 microns to 1000 microns.

* * * * *